United States Patent [19]

Aufderhaar

[11] Patent Number: 4,551,926

[45] Date of Patent: Nov. 12, 1985

[54] NOZZLE BOX FOR HEAT TREATMENT OF VENEERING

[75] Inventor: Herbert Aufderhaar, Ibbenbüren, Fed. Rep. of Germany

[73] Assignee: C. Keller GmbH u. Co. KG Maschinenfabrik, Ibbenbüren-Laggenbeck, Fed. Rep. of Germany

[21] Appl. No.: 613,364

[22] Filed: May 23, 1984

[51] Int. Cl.[4] ..... F26B 3/04; F26B 13/10

[52] U.S. Cl. ..... 34/23; 34/155; 34/156; 226/97

[58] Field of Search ..... 34/155, 156, 160, 23, 34/34; 226/97

[56] References Cited

U.S. PATENT DOCUMENTS 3,979,038 9/1976 Karlsson ..... 34/156

4,142,301 3/1979 Goodall ..... 34/155

4,271,601 6/1981 Koponen et al. ..... 34/155

4,438,572 3/1984 Kaminski ..... 34/155

*Primary Examiner*—Larry I. Schwartz

*Attorney, Agent, or Firm*—Horst M. Kasper

[57] ABSTRACT

The invention provides a nozzle box for the heat treatment of veneering in a veneer dryer, where hot air is fed via nozzles on the side of the nozzle box disposed toward the veneering onto the surface of the passing veneering. The edges of the nozzle holes are bent in the direction toward the veneering, and they form funnel-shaped holes for the outflowing hot air. The funnel-shaped holes are recessed toward the inside of the nozzle box and are disposed in a region beat out inwardly and the beat out edges have an about circular cross-section. In addition, a bevel is provided to improve the guiding of the veneer sheets.

14 Claims, 2 Drawing Figures

NOZZLE BOX FOR HEAT TREATMENT OF VENEERING

BACKGROUND OF THE INVENTION

1. Field of the Invention

The present invention relates to a nozzle box for heat treatment of veneering in a veneering dryer, which is provided with nozzles on its side disposed toward passing veneering for providing hot air to the veneering surfaces.

2. Brief Description of the Background of the Invention Including Prior Art

The German Patent Application Laid Open DE-OS No. 1,943,856 teaches such a drying box, where the bent edges of the nozzles protrude into the space where the veneering passes. In general, it is desirable to bring the nozzle box as close as possible to the veneering to be dried and since the veneering is not always of flat shape and since in particular the edge zones are not planar, there exists the danger that the veneer during the transport past the nozzle box collide with the protruding edges of the nozzle holes or, respectively, with the edges of the nozzle boxes, that they stop moving and begin to clog the line and the veneer dryer. The danger of clogging exists in particular with roller driven dryers, where the veneering is transported, supported and guided only by rollers disposed at certain distances.

SUMMARY OF THE INVENTION

1. Purposes of the Invention

It is an object of the present invention to provide a nozzle box for heat treatment of veneering, which substantially avoids a clogging of the veneering passing by.

It is another object of the present invention to improve the flow of hot air toward the veneering surfaces passing the nozzle box.

It is a further object of the invention to provide an improved method for the drying of veneering.

These and other objects and advantages of the present invention will become evident from the description which follows.

2. Brief Description of the Invention

The present invention provides a nozzle box for the heat treatment of veneer in a dryer for veneers which comprises a bevel at the side of the box facing the veneering and located at the edge where the veneering is approaching, annular recesses on the side of the box facing the veneering, and a funnel-shaped hole in the middle of the annular recess for treating the veneering with hot air.

Preferably, the box comprises a plurality of nozzles and the box cross-section decreases with decreasing hot air flow volume. The decrease of the cross-section can be provided by an inclined surface at the side of the box remote from the passing veneering. The annular recess can have a cross-section near the funnel-shaped hole, which is suited to provide directed high speed and substantially laminar hot air flow to the veneering. The cross-section of the annular recess near the funnel-shaped hole can be about a section of a circle. The cross-section of the annular recess at its junction with the bulk of the nozzle box can be inclined at an angle of from about 10 to 45 degrees.

The orifice of the nozzle can be recessed versus a substantially planar side of the nozzle box facing the veneering by from about 0.1 to 0.5 of the depth of the annular recess. The diameter of the recess can be from about 2 to 5 times the diameter and is preferably about 2.5 to 4 times the diameter of the funnel-shaped opening. The exit direction of the hot air can be about vertical to the planar side of the nozzle box facing the veneering.

There is also provided a method for heat treatment of veneering in a dryer for veneering which comprises disposing a nozzle box with the nozzle side facing passing veneering, feeding hot air into the nozzle box, pressing the hot air out of the nozzle box through recessed nozzles supported by an annular recess in the nozzle side of the nozzle box such that the hot air impinges on the veneering.

The hot air coming out of the nozzles can show a substantially laminar flow. The speed of flow of hot air in the nozzle box can be maintained about constant by decreasing the cross-section of the nozzle box as the volume of hot air passing decreases. The oncoming veneering can be protected against collision with the nozzle box by providing a bevel at the edge of the nozzle box facing the oncoming veneering. The veneering can be moved past the nozzles with rotating rollers providing the respective moving force to the veneering.

Since the bent over edges of the hole nozzles no longer protrude into the transporting area of the veneer sheets due to the recessed construction in the interior of the nozzle box, there is no longer any interference with the transport of the veneering sheets. In addition, the bevel at the edge of the nozzle box meeting the oncoming veneering provides for a better guidance of the veneering. The circular form of the bent over edges is advantageous and ensures that no separating turbulences can occur. The inward bending of the hole nozzle to the interior of the nozzle box is advantageous, as the hot air accumulates and becomes compressed, which results in an advantageous outflow of the air at a high speed.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
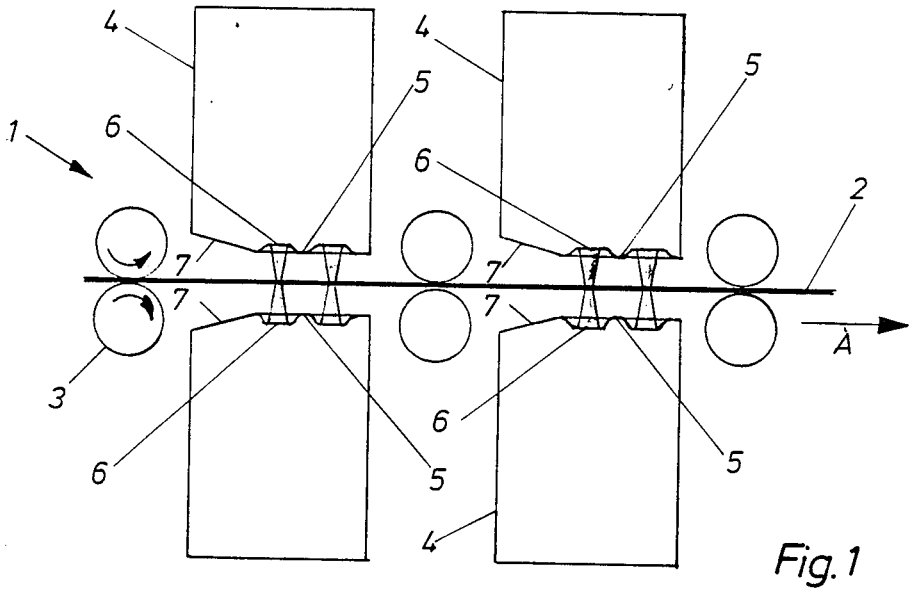
FIG. 1 is a sectional schematic view of the arrangement of nozzle box in a roller dryer.
Figure 2:
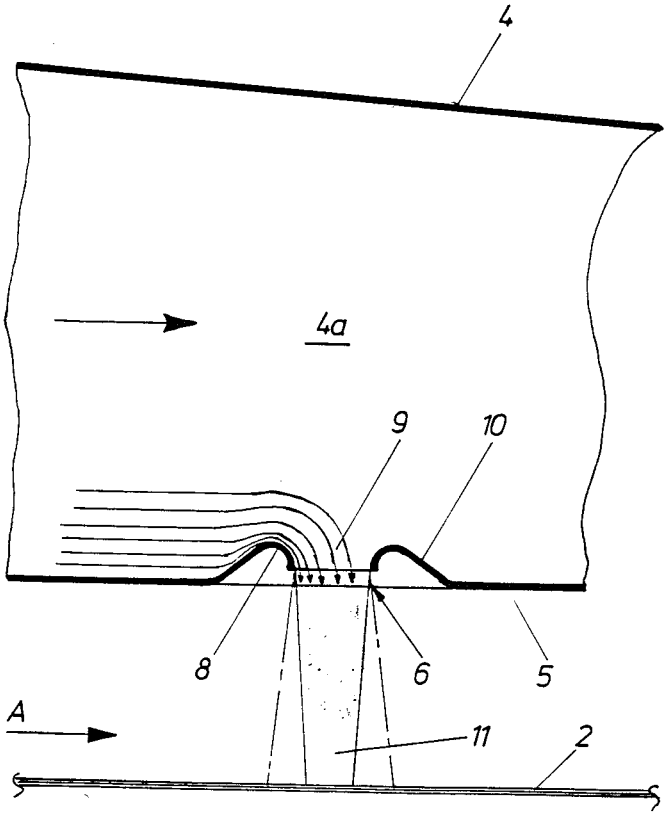
FIG. 2 is a sectional view at a larger scale of the nozzle box in the region of a hole nozzle.

In accordance with the present invention there is provided a nozzle box for heat treatment of veneering in a veneering dryer, which is provided with hole nozzles for impinging the veneering materials with hot air and where the hole nozzles are provided on the side facing the passing veneering. The edges of the nozzles are bent over toward the veneering and the holes have shapes about like a funnel. The funnel-shaped holes 9 are recessed toward the inner space 4*a* of the nozzle box 4 and are about at the center of a bent out region 10, where the bent over edges 8 are circular. The nozzle box 4 is provided with a bevel 7 for furnishing a better guidance to the veneer sheets 2.

The veneering sheets 2 are led through the dryer 1 with rollers 3. Nozzle boxes 4 are disposed above and below of the veneering sheets 2, and they are disposed perpendicular to the transport direction (arrow A) of the veneers 2. Each nozzle box 4 is provided with hole nozzles 6 on the side 5 disposed toward the bypassing veneering sheets. Preferably the hole nozzles are disposed in two rows on either side and perpendicular to the advance direction of the veneering sheets 2. The holes can be disposed staggered such that the full surface of the veneering sheet 2 is covered by the onflowing hot air. Each nozzle box is provided with a bevel 7 for better guiding of the veneering sheets 2, such that a colliding veneering sheet 2 does not get stuck and canted at the nozzle box 4.

Each nozzle hole 6 is bent over at the edge 8 in the direction of the veneering bypassing and it forms a funnel-shaped hole. The funnel-shaped hole 9 is recessed toward the inner space 4*a* of the nozzle box 4 and is disposed in a region 10 bent over and/or beat out inwardly. The bent over edge 8 is formed as a circle in order to allow for better guiding of the air. The air beam (core beam) 11 exiting from the hole nozzle therefore impinges at a high speed on the veneering surface and destroys and penetrates the gaseous boundary layer surrounding the veneering surface 2. This ensures that a high evaporation speed (drying power) is achieved.

It will be understood that each of the elements described above, or two or more together, may also find a useful application in other types of drying system configurations and veneering processing procedures differing from the types described above.

While the invention has been illustrated and described as embodied in the context of a nozzle boz for heat treatment of veneering, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A nozzle box for the heat treatment of veneer in a dryer for veneers comprising a bevel at the side of the box facing the veneering and located at the edge where the veneering is approaching; annular recesses on the side of the box facing the veneering with a first portion of the recesses extending into the box and a second portion adjoining the first portion in the box and reverting to the outside to define a funnel-shaped hole in the middle of the annular recess for guiding hot air to treat the veneering.

2. The nozzle box for the heat treatment of veneer in a dryer for veneers according to claim 1 wherein the box comprises a plurality of nozzles and where the box cross-section decreases with decreasing hot air flow volume.

3. The nozzle box for the heat treatment of veneer in a dryer for veneers according to claim 2 wherein the decrease of the cross-section is provided by an inclined surface at the side of the box remote from the passing veneering.

4. The nozzle box for the heat treatment of veneer in a dryer for veneers according to claim 1 wherein the annular recess has a cross-section near the funnel-shaped hole, which is suited to provide directed high speed and substantially laminar hot air flow to the veneering.

5. The nozzle box for the heat treatment of veneer in a dryer for veneers according to claim 1 wherein the cross-section of the annular recess near the funnel-shaped hole is about a section of a circle.

6. The nozzle box for the heat treatment of veneer in a dryer for veneers according to claim 1 wherein the cross-section of the annular recess at its junction with the bulk of the nozzle box is inclined at an angle of from about 10 to 45 degrees.

7. The nozzle box for the heat treatment of veneer in a dryer for veneers according to claim 1 wherein the orifice of the nozzle is recessed versus a substantially planar side of the nozzle box facing the veneering by from about 0.1 to 0.5 of the depth of the annular recess.

8. The nozzle box for the heat treatment of veneer in a dryer for veneers according to claim 1 wherein the diameter of the recess is from about 2 to 5 times the diameter of the funnel-shaped opening.

9. The nozzle box for the heat treatment of veneer in a dryer for veneers according to claim 1 wherein the exit direction of the hot air is about vertical to the planar side of the nozzle box facing the veneering.

10. A method for heat treatment of veneering in a dryer for veneering comprising disposing a nozzle box with the nozzle side facing passing veneering;

feeding hot air into the nozzle box;

pressing the hot air out of the nozzle box guided through recessed nozzles supported by an annular recess with a first portion of the recess extending into the box and a second portion adjoining the first portion in the box and reverting to the outside to define a funnel shaped hole in the middle of the annular recess such that the hot air impinges on the veneering.

11. The method for heat treatment of veneering in a dryer for veneering according to claim 10 further comprising the hot air coming out of the nozzles shows a substantially laminar flow.

12. The method for heat treatment of veneering in a dryer for veneering according to claim 10 further comprising maintaining the speed of flow of hot air in the nozzle box about constant by decreasing the cross-section of the nozzle box as the volume of hot air passing decreases.

13. The method for heat treatment of veneering in a dryer for veneering according to claim 10 further comprising protecting the oncoming veneering against collision with the nozzle box by providing a bevel at the edge of the nozzle box facing the oncoming veneering.

14. The method for heat treatment of veneering in a dryer for veneering according to claim 10 further comprising moving the veneering past the nozzles with rotating rollers providing the respective moving force to the veneering.

* * * * *